United States Patent [19]

Jacobsz

[11] 4,101,258

[45] Jul. 18, 1978

[54] FUEL BURNER SEQUENCING DEVICE WITH SAFETY CHECKING MEANS

[75] Inventor: Roelof F. Jacobsz, Blaine, Minn.

[73] Assignee: Honeywell Inc., Minneapolis, Minn.

[21] Appl. No.: 800,244

[22] Filed: May 25, 1977

[51] Int. Cl.[2] ..... F23Q 23/00

[52] U.S. Cl. ..... 431/26; 431/31; 431/60; 431/78

[58] Field of Search ..... 431/24–26

[56] References Cited

U.S. PATENT DOCUMENTS 3,143,162 8/1964 Graves ..... 431/26

3,644,748 2/1972 Lord ..... 431/26

3,814,569 6/1974 Jacobsz ..... 431/26

*Primary Examiner*—Carroll B. Dority, Jr.

*Attorney, Agent, or Firm*—Alfred N. Feldman

[57] ABSTRACT

A fuel burner sequencing means is disclosed which utilizes a bistable or alternate action switching means for safety checking. The bistable switching means is specifically disclosed as a bistable relay that operates at the start of the cycle, and at the end of the cycle to check the operability of the safety checking means. This same bistable relay means is used as a lockout means in the event of the failure of flame when a flame should exist in the burner, or when a flame is indicated and none should be present.

10 Claims, 6 Drawing Figures

EQUIPMENT EXTERNAL TO BURNER SEQUENCING MEANS SHOWN DASHED ----

ALL CONTACTS SHOWN AT TIME = 0 SECONDS

TIMER CONTACTS — N.O. ; N.C

RELAY CONTACTS — N.O. ; N.C.

TIMER CONTACTS EACH ARE SHOWN WITH TIMES OF OPERATION

FIG. 5 – BURNER CONDITION

FUEL BURNER SEQUENCING DEVICE WITH SAFETY CHECKING MEANS

BACKGROUND OF THE INVENTION

In the operation of relatively large fuel burners it has been past practice to provide a safety checking device or circuit that would shut down the burner in a safe manner and would lock out thereby requiring manual reset before the burner could be restarted. Most of the lockout devices utilized have been of the thermal type that require 10 to 15 seconds of improper operation before they respond and turn off the burner. In most burner sequencing equipment, the shut down occurs in the event that a flame is sensed by a flame sensing means when none should be present, or no flame is sensed when a flame should be present. The delay allowed by the thermal type safety lockout devices is undesirable. In addition, the point at which the system had failed, thereby indicating what portion of the burner cycle is defective, has not been readily indicated. If it is desirable to know at what point the burner malfunctioned, it is normally necessary to add additional indicating equipment.

Magnetic type lockout devices have been used in place of thermal type lockout devices. This overcomes the delay, but the magnetic type lockouts have not provided the safety checking feature incorporated in the present invention.

SUMMARY OF THE INVENTION

The fuel burner sequencing means presently disclosed incorporates a new type of safety checking means which is capable of shutting a fuel burner down immediately upon the occurrence of an adverse event. The present invention provides for a special alternate action type of safety checking means which can respond immediately to a malfunction and stop the burner cycle at the point in time when the malfunction occurs. This same safety checking means, through an alternate action arrangement, is caused to operate at the beginning and end of each complete burner cycle thereby proving that the alternate action safety checking means itself is functioning properly.

The alternate action safety checking means specifically disclosed is a bistable type of relay means utilizing a pair of coils which are energized to cause the alternate action of the relay means. This alternate action occurs at the beginning and end of each normal burner cycle thereby checking the device itself. In the event that a malfunction occurs during the normal sequence of the burner operation, the present relay device immediately operates to safely shut down the fuel burner and leaves the sequencing means in the position where the malfunction occurred. Prior to resetting of the sequencing means, the exact point in the sequence where the malfunction occurred can be noted and thereby allows for more convenient location of the problem.

BRIEF DESCRIPTION OF THE DRAWINGS

FIG. 5 is a graph of the position of the dampers in a fuel burner associated with the system of FIG. 3.

DESCRIPTION OF THE PREFERRED EMBODIMENT

Figure 1:
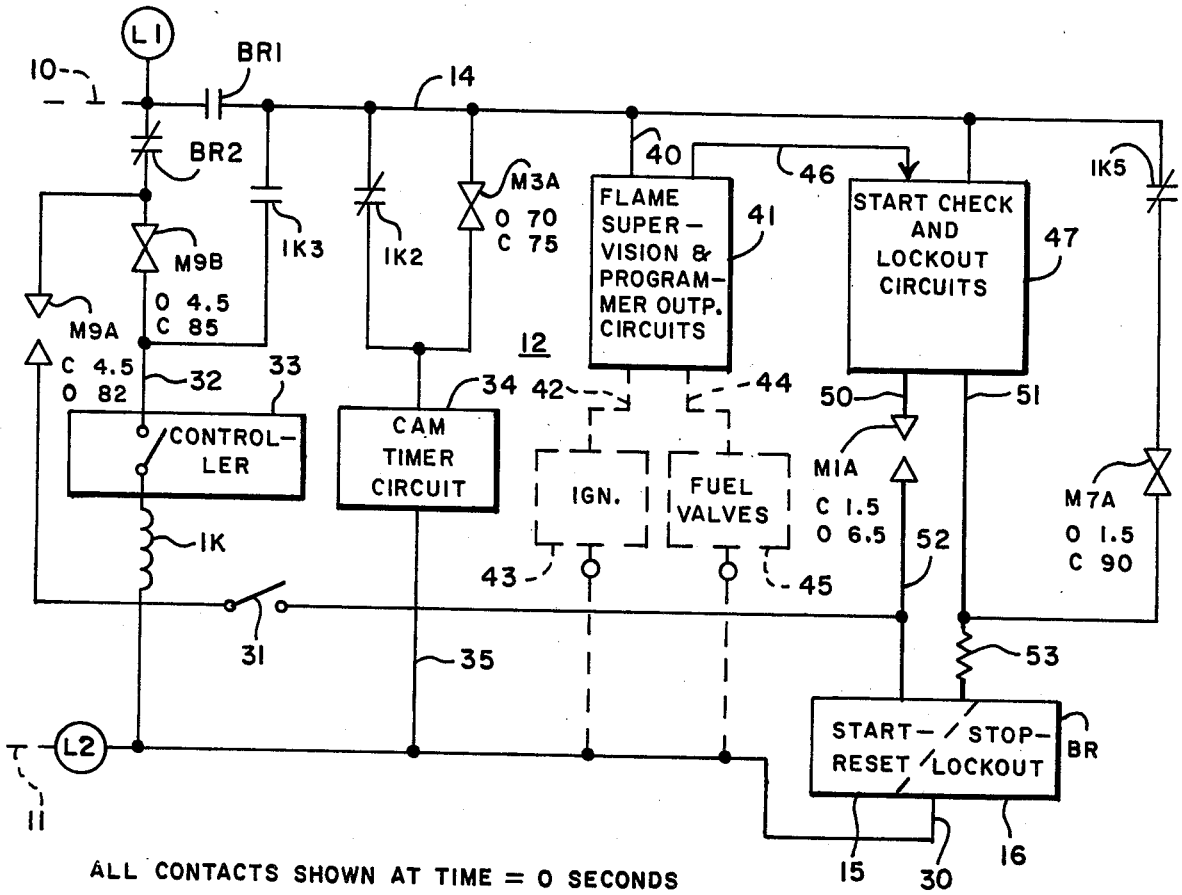
FIG. 1 is a highly simplified schematic drawing of a fuel burner sequencing means using the present invention.

In FIG. 1 a highly simplified version of a fuel burner sequencing means has been disclosed. Much of the conventional circuitry and structure of a fuel burner sequencing means using motor driven cam switches and relays have been disclosed in block. The circuitry necessary to practice the present invention, and to explain its operation has been disclosed. The fuel burner sequencing means has been disclosed at time equals zero in the sequence, and each of the motor driven cam operated switches has been shown with their normal opening and closing times for convenience in consideration of the circuitry.

A pair of energizing lines 10 and 11 are shown connected to the fuel burner sequencing means generally disclosed at 12. The line 10 is connected to a terminal L1 and line 11 is connected to the terminal L2. Terminal L1 is connected through a normally open contact BR1 to a conductor 14 that supplies power during a portion of the cycle to the majority of the circuits in the fuel burner sequencing means 12. Terminal L1 is also connected to a normally closed contact BR2. The contacts BR1 and BR2 form the contact means of an alternate action safety locking means or bistable relay BR. The bistable relay BR is shown in detail in FIG. 2 and it is basically made up of a start-reset coil 15 and a stop-lockout coil 16. The bistable relay means or alternate action safety checking means BR can be any type of alternate action device. The device could be a stepping relay having a single magnetic coil, and a pair of alternate action contacts.

Figure 2:
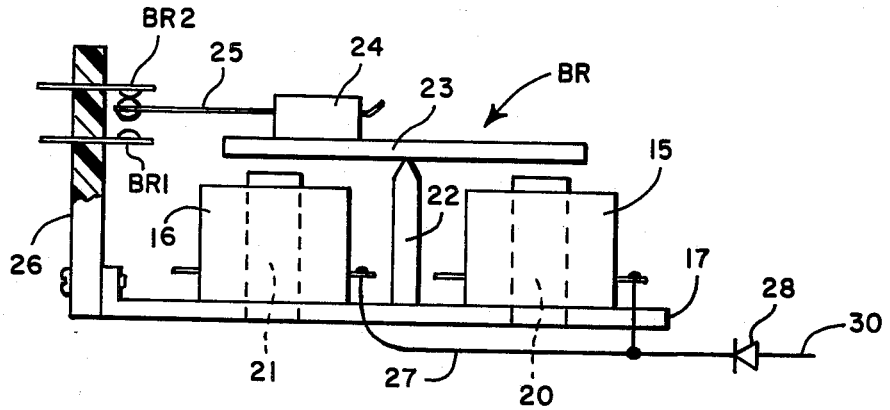
FIG. 2 is a representation of a two-coil bistable relay utilizing a permanent magnet to lock the relay in an operated position.

In FIG. 2 the bistable relay BR is disclosed in some detail and will be described at this point so that its operation will be understood in connection with the operation of FIG. 1. The bistable relay BR has the two previously mentioned coils 15 and 16 mounted on a common magnetic base 17. The coil 15 has a pole 20 and the coil 16 has a pole 21 which are connected to the base 17. A permanent magnet 22 forms a center support and pivot for an armature 23 that in turn supports an insulating block 24 and a contact arm 25 that is operated between a pair of contacts BR1 and BR2. The contacts BR1 and BR2 are supported by an insulating support 26. The coils 15 and 16 are connected by a common conductor 27 through a diode 28 to a conductor 30. The bistable relay BR forms a conventional polarized type of bistable relay that provides an alternate action depending on whether coil 15 or coil 16 is energized. This type of relay is well understood in the art and will not be described in more detail.

In FIG. 1 the contact BR2 is connected jointly to an open contact or switch M9A and the closed contact M9B. Contact M9A is connected through a manually operated switch 31 that is in turn connected to the coil 15 of the relay BR. The switch 31 is a manual reset switch. The switch M9B is further connected by a conductor 32 to a controller 33. The controller 33 can be a thermostat, manual switch, or any type of condition responsive switch means. The controller 33 is connected to a relay 1K which in turn is connected to terminal L2. The input or starting circuit for the present device is completed by a relay contact 1K3 that is connected between conductor 32 and conductor 14.

Connected between the conductor 14 and the line L2 is a further relay contact 1K2 paralleled by a timer contact M3A. This pair of contacts is connected to a cam timer circuit 34 that includes a synchronously operated motor and a series of cam driven switches. The cam timer circuit 34 and its motor driven cam operated switches are conventional in fuel burner sequencing equipment. The cam timer circuit 14 is completed by conductor 35 to the terminal L2. Connected between the conductor 14 and the terminal L2 is a conductor 40 which supplies energy to a flame supervision and programming output circuit 41 that in turn is connected by a conductor 42 to an ignition device or transformer 43 that is connected to the line L2. Also connected from the flame supervision and programming device 41 are the necessary conductors 44 to fuel valves 45 that are in turn connected to the line L2. A single fuel valve structure has been shown at 45. This could be a family of fuel valves in larger burner installations. The flame supervision and programmer output circuits 41 would have cam operated switches to properly sequence any number of fuel valves that were desired.

The flame supervision and programmer output circuits 41 also has an output circuit 46 to a circuit 47 that is a start check and lockout circuit for the present device. The start check and lockout circuit 47 is energized from conductors 14 and has a pair of output circuits 50 and 51. The output circuit 50 is connected to an open timer contact M1A and to a conductor 52 that is connected to the coil 15 of the bistable relay BR. The start check and lockout circuit 47 via conductor 51 is connected through a resistor 53 to the coil 16 of the bistable relay BR. The resistor 53 makes the bistable relay BR preferential in its operation giving the coil 15 preference over the coil 16. The system is completed by connecting a normally closed relay contact 1K5 and the closed switch contact M7A from the conductor 14 to the resistor 53.

OPERATION OF FIG. 1

The operation of FIG. 1 will be described very briefly and it should be understood that the various elements that have been shown in block operate in a conventional fashion. They will be specifically shown in detail in connection with FIG. 3 through FIG. 5.

Prior to starting, the circuit of FIG. 1 is in the condition as shown. To start the device the controller 33 closes calling for heat or the beginning of a burner cycle. This energizes relay 1K through the normally closed contact BR2 and the closed switch contact M9B. Immediately the contact 1K3 closes latching in the relay 1K and opening the contacts 1K2 and 1K5. The closing of contact 1K3 completes an energizing circuit through the conductor 14 and contact M3A to the cam timer circuit 34 and conductor 35 to the line L2 thereby starting the synchronous motor that drives the cam operated switch arrangement or the programmed switch means for the system.

After the system has been in operation 1.5 seconds the contact M1A closes energizing the start check and lockout circuit 47 and the relay coil 15. When the relay coil 15 is energized, the effect of the permanent magnet 22 is diminished, and the flux from the permanent magnet 22 flows through the core 21 of coil 16 causing the armature 23 to tip thereby opening the normally closed contact BR2 and closing the normally open contact BR1. The relay BR stays latched in this position since it is a polarized or latching type of relay. This checks the operability of the relay BR which is part of the safety function of the present invention. At this same time the contact M7A opens and stays open disabling the circuit to coil 16 until the end of the program or until an unsafe condition occurs and its operation is caused by power being supplied on conductor 51.

At 4.5 seconds into the operation of the device, the relay BR must have changed state or the entire system will be deenergized and locked out requiring manual reset by the closing of the switch 31. This is accomplished by the contact M9B opening thereby opening the original starting circuit at which time the only holding circuit for the relay 1K is through the closed contact BR1 and the closed contact 1K3. At this point in time the bistable relay BR changes its function from a startup device to a lockout safety device that is under the control of the start check and lockout circuits 47. At any time after 4.5 seconds, if the flame supervision and programmer circuit 41 senses a flame when none should be present, or fails to sense a flame when a flame should be present, energy is supplied on conductor 46 to the start check and lockout circuits 47 and energy is supplied on conductor 51 to the resistor 53 and the stop lockout coil 16 of the present device. This would cause the bistable relay BR to change states once again opening the contact BR1 and closing the contact BR2. Since the timer has opened the contact M9B at this point in time, the energy for the controller 33 and the relay 1K would be lost.

This arrangement provides for a safety lockout at any time a malfunction occurs and that safety lockout is not delayed by the normal expedient of a thermally operated safety switch. The lockout occurs almost instantaneously. This provides two very distinct and desirable features. The first feature is that the device functions almost instantaneously thereby preventing fuel from entering the burner and accumulating providing an unsafe or undesirable condition. Secondly, the stopping of the cam timer circuit 34 at the point in the cycle where there is a malfunction allows the service person to check the device and see exactly at what point in the cycle the malfunction occurred. This eliminates the need of any type of enunciator lights, as a check of the position of the cam timer circuit device 34 will tell the servicing personnel at what point the malfunction occurred.

At 70.0 seconds, the contact M3A opens stopping the cam timer circuit 34 in the run condition at which time the burner will remain energized as long as the controller 33 is closed or satisfied. As soon as the controller 33 is satisfied, it open circuits and the relay 1K drops out. The dropping out of the relay 1K closes the contact 1K2 thereby starting the timer circuit 34 so that the device can run out through a postpurge cycle that is normal in most burner sequencing means. The deenergization of relay 1K also closes contact 1K5 and puts the contact 1K5 in series with the contact M7A. As soon as the cam timer circuit 34 drives the device to the end of its cycle, that is 90.0 seconds, the contact M7A closes and the stop-lockout coil 16 of the bistable relay BR is energized thereby causing the bistable relay BR to cycle to its starting position once again. This cycle rechecks the operability of the bistable relay BR. If the relay BR fails to cycle, the device cannot start at the beginning of the next call for heat.

The above highly simplified burner sequencing means has been disclosed merely to show the operation of the present invention. In the following FIGS. 3 through 5 an actual complete fuel burner sequencing means will be disclosed very briefly.

DESCRIPTION OF FIGS. 3 AND 3A

Figure 3:
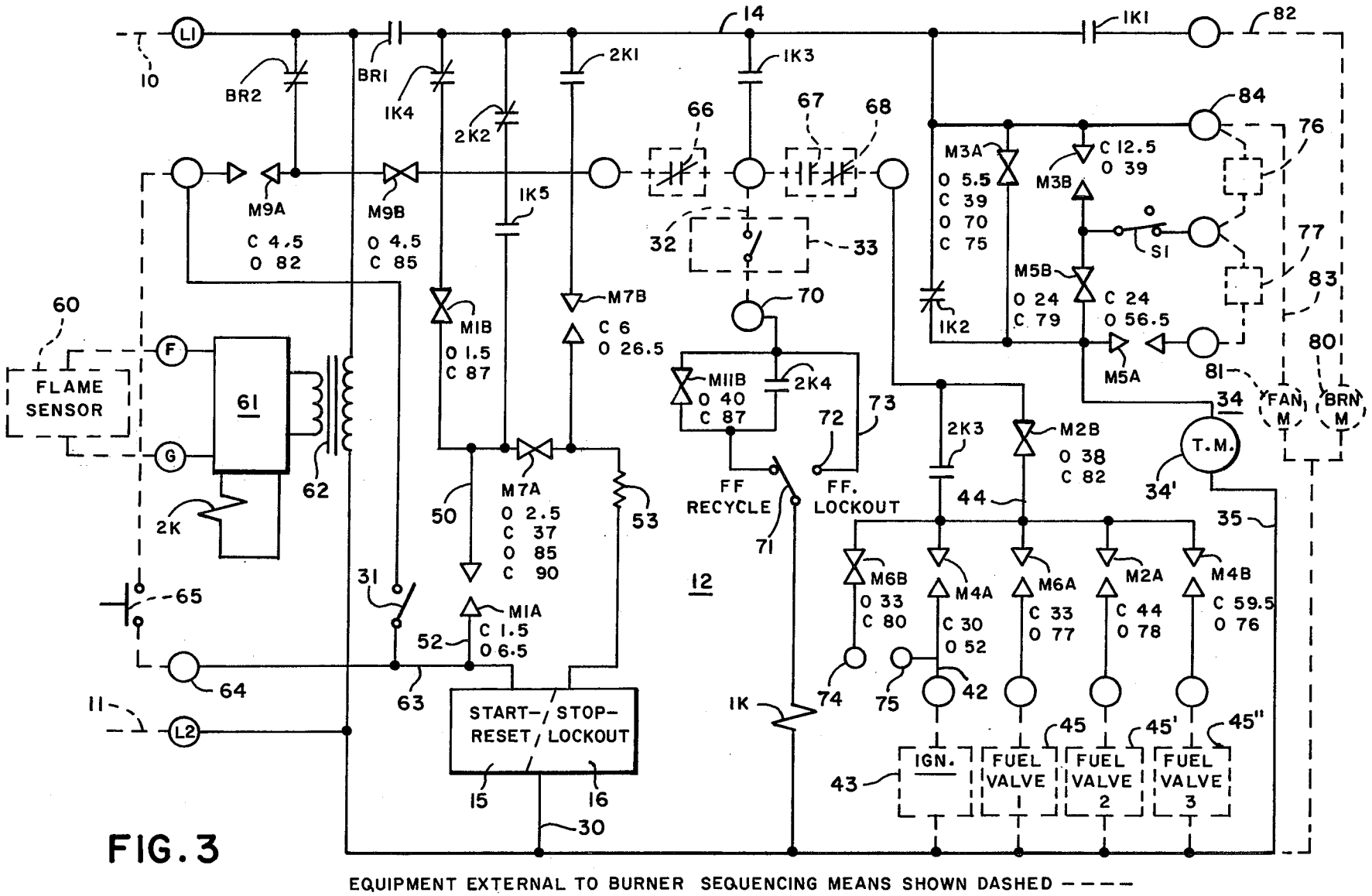
FIG. 3 is a detailed and complete circuit diagram of an actual fuel burner sequencing means.
Figure 3A:
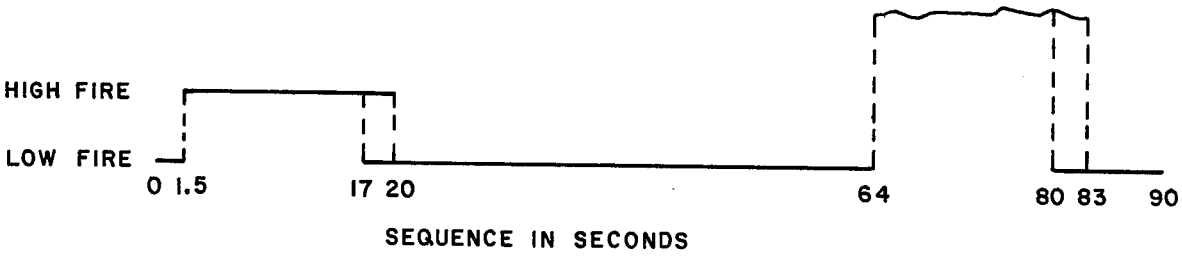
FIG. 3A is a schematic representative of a motor circuit for a damper associated with the fuel burner sequencing means of FIG. 3.
Figure 3A:
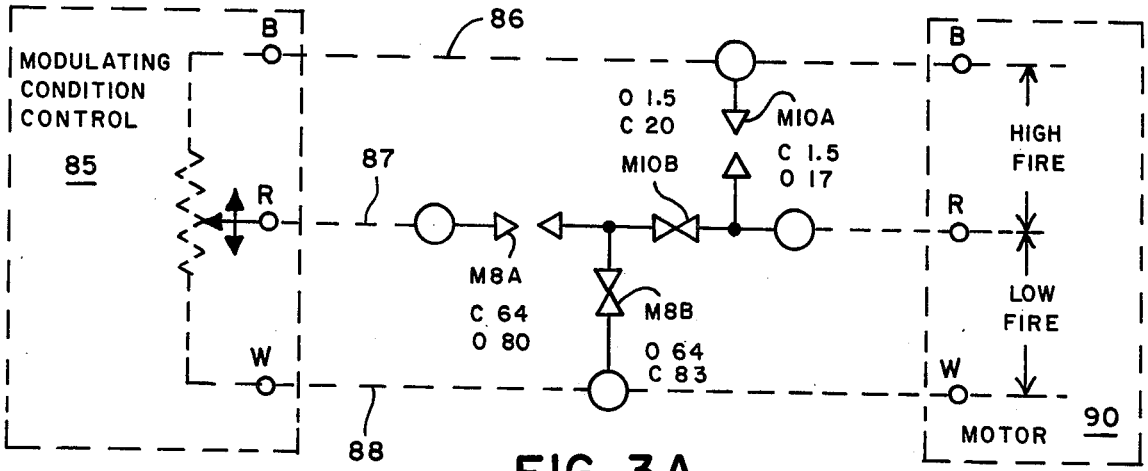

The fuel burner sequencing means 12 has been disclosed in FIGS. 3 and 3A in a complete, detailed form. The drawing not only includes the fuel burner sequencing means 12, but discloses the auxiliary equipment that is attached to the fuel burner sequencing means 12 to provide a complete fuel burner control device. The equipment that is external to the burner sequencing means 12 itself is shown dashed and is not part of the present invention, but is part of the equipment to which the fuel burner sequencing means 12 is connected to complete a system. The particular system to which it is attached is not material to the present invention. The present invention could be adapted to any type of fuel burner system that uses a program switch means and relays to operate additional switches in response to flame sensor equipment and auxiliary safety and control equipment. Since the disclosure of FIGS. 3 and 3A is mostly of a conventional system, the present description will be abbreviated as this type of system is well known in the art. All of the relay contacts have been conventionally designated with a coding of which relay is involved, and the contact number. The sequencing switches have been disclosed as M1A, M1B, M2A, M2B, etc., and each of the cam operated switches has shown its opening and closing times for a device which has a normal operating cycle of 90 seconds. As far as practical, the same numbers will be used in FIGS. 3 and 3A as appeared in connection with FIGS. 1 and 2.

A flame sensor 60 is shown connected to the F and G terminals of the fuel burner sequencing means 12. Contained in the fuel burner sequencing means 12 is a flame amplifier 61 which is powered from a transformer 62 that is connected across the lines L1 and L2. The flame amplifier 61 controls a relay 2K that has a number of relay contacts designated as 2K1, 2K2, 2K3, 2K4 and 2K5. All of these relay contacts are operated on the sensing of flame by the sensor 60 through the medium of the flame amplifier 61, in a well-known fashion.

The cam timer circuit 34 includes a timer motor 34' that is connected by the conductor 35 and the normally closed relay contact 1K2 and the timer contact M3A to conductor 14. The timer motor 34' drives a set of cams by the operation of a synchronous motor, as is well known in this art. All of the cam operated switches have been disclosed and are designated as M1A, M1B, M2A, etc., along with their normal opening and closing times. A bar chart of the entire sequence is disclosed in FIG. 4. All of the individual cam operated switches and relay operated switches will not be specifically enumerated. Only the equipment in addition to the relay operated switches and cam operated switches will be noted below.

The reset switch 31 is again disclosed connected by a conductor 63 to the coil 15 and to a terminal 64. The terminal 64 is adapted to be connected by a switch 65 in parallel with the switch 31. The switch 65 can be operated at any remote location from the device, if that is desired as a reset mechanism. The bistable relay BR is again disclosed having coils 15 and 16 that are connected in the same manner as disclosed in FIG. 1. The relay BR has the normally closed contact BR2 and the normally open contact BR1 in the same circuit positions as disclosed in FIG. 1 and the operation is the same.

Also, specifically disclosed are the necessary auxiliary equipment to make up a complete fuel burner device. An air flow responsive switch 66 is disclosed having a normally closed contact section and at 67 a normally open contact section. In series with the contact 67 is a normally closed safety limit contact 68. The air flow switch 66 and 67 provides for checking of the air flow in the burner and by using both a normally closed contact 66 and an open contact 67 it is possible to check the operation of the air flow switch to make sure that its contacts have not inadvertently welded. The controller 33 has again been disclosed. In this case the controller 33 is connected to a terminal 70 that is connected through either contact M11B or the normally open relay contact 2K4 through a two position switch 71. The two position switch 71 can be set in the position shown and is in series with the 1K relay. The switch 71, in the position shown, allows the system to automatically recycle in the event of a flame failure. If the switch 71 is connected to terminal 72 which bypasses by conductor 73, the parallel combination of contact M11B and the normally open relay contact 2K4, the device will lock out and operate much as disclosed in FIG. 1. The switch 71 is an optional feature.

Also provided in the system is the ignition means 43 and the plurality of fuel valves disclosed as 45, 45' and 45''. The number of individual valves or stages is a function of the number of cam operated switches available and necessary for the operation of a particular burner. In the presently disclosed device a normally closed cam operated switch M6B is provided with a terminal 74 adjacent to a terminal 75 that is connected to the ignition device 43. If it is desired to provide for a prepurge ignition spark cycle, a jumper can be provided across the terminals 74 and 75 thereby providing ignition continuously during the prepurge portion of the cycle. This is necessary and desirable in certain countries and with certain types of burners. This additional feature will ignite any leakage oil into a fuel burner during the prepurge portion thereby activating the flame sensor 60 and locking the system out at that point in its operation. This type of fault detection has been used elsewhere, and is merely an auxiliary function of the present device.

To complete the auxiliary equipment, a high fire switch 76 and a low fire switch 77 are disclosed connected in the cam operated sequence of the device. These are conventional switches which sense the position of dampers that are motor driven as disclosed in FIG. 3A. It is normal to purge a fuel burner in the high fire position, which is sensed by the switch 76, to allow for a complete air flow or prepurge of the burner. It is then desirable to have the motor, disclosed in FIG. 3A, drive the system to the low fire position so as to allow the burner to ignite the burner at the low fire position. Once again the high fire 76 and the low fire 77 are conventional auxiliary equipment to fuel burner sequencing systems.

The entire system is completed by connecting the burner motor, which has been disclosed at 80, and the fan motor 81 to the system. The burner motor 80 is connected by conductor 82 to the relay contact 1K1 which closes as soon as the controller calls for operation of the device thereby starting the burner motor. The fan motor 81 is connected by conductor 83 to a terminal 84 that is in turn connected directly back to conductor 14 so that the fan motor obtains power as soon as the system is put into operation.

In FIG. 3A a modulating condition control device 85 has been disclosed and again is a piece of auxiliary equipment to the actual programmer or burner sequencing means 12. Device 85 is connected by three conductors 86, 87 and 88 to the cam operated contacts M8A, M8B, M10A and M10B which are in turn connected to a damper motor 90. The damper motor 90 operates a damper between the high and low fire positions to which the limit switches 76 and 77 are responsive in a conventional fashion. The equipment disclosed in FIG. 3A has been provided merely to complete the system and is not directly material to the actual novelty of the present invention.

OPERATION OF FIG. 3

The operation of the fuel burner sequencing means 12 will be described at specific points in time and in connection with the bar chart disclosed in FIG. 4.

At the zero point of time, the bistable contacts BR1 and BR2, as well as all of the relay contacts and cam operated contacts are in the position shown in FIG. 3. The system is started by the controller 33 closing which immediately energizes relay 1K thereby changing the position of all of the contacts 1K1, 1K2, 1K3, 1K4 and 1K5. The air flow switch 66 is closed thereby allowing power to be drawn through the contact M9B and the normally closed contact BR2 from the line L1. The pull-in of the 1K relay closes contacts 1K1 which supplies power to the burner motor 80. The fan motor 81 has already been energized by a circuit through BR2, M9B, the normally closed air flow switch 66, and the now closed relay contact 1K3. This places the sequencing means 12 into operation in the prepurge portion of a burner cycle.

At 1.5 seconds into the operation of the device, the contact M1A closes and this energizes the start-reset coil 15 of the relay BR. The relay BR changes state from the stop-lockout state to the start-reset state, as was disclosed in connection with the operation of FIG. 1. The contact BR1 closes maintaining power to the circuit. The contact BR2 opens. The cam operated switch (FIG. 3A) M10A closes and M10B opens, thereby causing the motor 90 to drive the dampers into the high fire position for the high fire prepurge of the burner.

At 2.5 seconds into the operation the switch M7A opens and electrically separates the start-reset coil from the stop-lockout coil in the system.

At 4.5 seconds into the operation a major function occurs. The switch M9A closes and M9B opens. The closing of contact M9A prepares an alarm circuit (not shown) and M9B prevents the 1K relay from pulling in beyond this point in the operation if the 1K relay should open. The opening of the 1K relay circuit at this point in time, brought about by any cause, operates the BR relay causing the system to lock out.

At 5.5 seconds into the operation the contact M3A opens to deenergize the timer motor 34' in order to prove that the damper has reached the high fire position or holds the system operation until the damper does reach the high fire position. This requires the closing of switch 76 in order to cause the timer motor 34' to continue operation.

At 6.0 seconds into the operation the switch M7B closes and this allows the sequencer means 12 to lock out in the event that the 2K relay pulls in closing contact 2K1. This is the protection against sensing a flame when none should be present.

At 6.5 seconds another critical function occurs. The contact M1A opens and deenergizes the start-reset coil 15 of the relay BR allowing the relay BR to lock out the programmer when the stop-lockout coil 16 is energized indicating a malfunction.

At 12.5 seconds the contact M3B closes and terminates the proof of the open damper for the prepurge cycle. At 17.0 seconds into the operation the contact M10A (FIG. 3A) opens and allows the motor 90 to go to the low fire position thereby operating the switch 77. At 20.0 seconds, the switch M10B closes and drives the motor 90 to the low fire position. These operations are shown in FIG. 5 in the high and low fire conditions of the burner along with the bar chart of FIG. 4. At 24.0 seconds into the operation the contact M5A closes and contact M5B opens. This deenergizes the timer motor 34'. The timer motor 34' stops and waits until the damper motor 90 closes the low fire switch 77 assuring that the low fire light off of the burner will be possible.

At 26.5 seconds into the operation the contact M7B opens and prevents the system lockout when the flame relay 2K pulls in closing the contact 2K1. At 30.0 seconds, the contact M4A closes. This has the effect of energizing the ignition transformer 43 when the option of connecting terminals 74 and 75 has not been elected. At 33.0 seconds the contact M6A closes and energizes the first of the fuel valves 45. This allows for the flow of fuel at the same time as an ignition exists.

At 37.0 seconds, the contact M7A closes and the presence of flame must be proved this time, that is the 2K relay has pulled in or the system will lock itself out. If the 2K relay drops out at any time beyond this point it causes a lockout by the operation of the switch BR thereby indicating the loss of flame when a flame should be present.

At 39.0 seconds the contact M3A closes and M3B opens. This terminates the proof of the low fire position and prevents a test switch S1, that is associated with the high and low fire switches 76 and 77, from being used. At 40.0 seconds the contact M11B opens. If the switch 71 is in the position shown, there is no action effective at this point. If the switch 71 is connected to terminal 72, a flame failure beyond this point in time will cause the programmer to lockout requiring manual reset by use of swithces 31 or 65.

In the time interval between 44.0 seconds and 70.0 seconds a number of contacts such as M2A closes, M4A opens, M5A opens, M4B closes, and M8A closes along with the opening of M8B. All of these functions are to properly energize the various fuel valves and to provide internal logic for the operation of the device. At time 70.0 seconds the switch M3A opens and this deenergizes the timer motor 34' to stop the timer motor for however long of a period is necessary to provide burner operation in response to the condition responsive means or controller 33. After 70.0 seconds, the opening of the controller 33 allows the system to once again operate by the closing of relay contact 1K2 to start the timer motor 34' to drive the system into the postpurge cycle. Many of the switches previously disclosed change position to establish themselves for the next cycle and their specific function will not be described. The only function that is of concern at this point is at 90.0 seconds when the contact M7A closes and energizes the stop-lockout coil 16 of the bistable relay BR causing the bistable relay to change states. This opens the contact BR1 and closes the contact BR2. This action deenergizes the timer motor 34' stopping the system at the end of the cycle, and the closing of the contact BR2 allows for the reenergization of the 1K relay when the controller 33 closes at the beginning of the next cycle.

Figure 4:
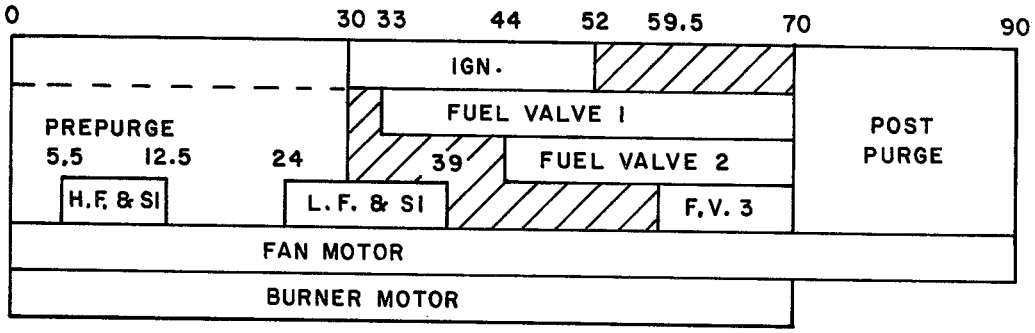
FIG. 4 is a bar chart of the actual sequence of the device of FIG. 3.

In FIG. 4 a bar chart has been provided which shows, in detail, the exact times when each of the various functions of the auxiliary equipment along with the burner sequencing means 12 occur. The bar chart is of conventional form and clearly brings out the operation of the device disclosed in FIGS. 3 and 3A. Since the bar chart is of conventional form no further explanation will be given.

In FIG. 5 a graph of the burner condition, as relates to the dampers driven by motor 90 is disclosed. It indicates that the damper normally starts at the low fire position and then is started towards the high fire position at 1.5 seconds into the operation of the device. Between 17.0 and 20.0 seconds the damper motor 90 is energized to move back from the high fire position to the low fire position in preparation for the beginning of the ignition and low fire start of a burner. The burner then stays in the low fire position until all of the various fuel valves have been opened and flame has been established in a satisfactory manner at 64.0 seconds. The motor 90 then drives the dampers into the high fire position where the dampers modulate through the operation of the burner under the control of the controller 33. At 80.0 to 83.0 seconds the dampers are again moved to the low fire position so that the system will be in the low fire state at the 90.0 second position thereby being ready to start the next cycle.

While one detailed fuel burner sequencing means has been disclosed, the invention of the present application can be applied to any type of fuel burner sequencing means that includes a programmed switch means and a relay operated switch means along with the alternate action safety checking arrangement which was specifically disclosed as a bistable polarized type of relay. Since there are many types of programming arrangements, relay arrangements, and bistable or alternate action checking means available, the invention could be applied in numerous fashions. As a result, the applicant wishes to be limited in the scope of his invention solely by the scope of the appended claims.

The embodiments of the invention in which an exclusive property or right is claimed are defined as follows:

1. A fuel burner sequencing means for controlling a fuel burner in response to a controller and which includes safety checking means, including: programmed switch means and relay operated switch means; flame sensor and amplifier means controlling a portion of said relay operated switch means in response to a flame at said burner; said burner sequencing means responsive to said controller to provide a normal fuel burner initiation and ignition cycle to establish a flame at said burner with said flame monitored by said flame sensor and amplifier means; and said sequencing means including alternate action safety checking means which includes contact means with a first contact open circuited when a second contact is close circuited; said contact means connected to supply power to said sequencing means in conjunction with said programmed switch means and said relay operated switch means; said safety checking means operating in response to the operation of said controller to power said sequencing means and at the termination of the operation of said sequencing means to reset itself for the next cycle of said sequencing means; said safety checking means operating after said normal burner initiation to immediately stop said sequencing means and turn off fuel to said burner in the event said flame sensor and amplifier means indicates the presence of flame when none should be present, or if flame sensor and amplifier means indicates the absence of flame when a flame should be present.

2. A fuel burner sequencing means as described in claim 1 wherein said programmed switch means is motor driven cam timer means including a plurality of switches.

3. A fuel burner sequencing means as described in claim 2 wherein said relay operated switch means includes two relays; a first of said relays being responsive to the operation of said controller; and a second of said relays being controlled by said flame sensor and amplifier means.

4. A fuel burner sequencing means as described in claim 3 wherein said alternate action safety checking means is electromechanically operated switch means including said first and said second contacts.

5. A fuel burner sequencing means as described in claim 4 wherein said electromechanically operated switch means is a bistable relay having a pair of operating coils.

6. A fuel burner sequencing means as described in claim 5 wherein said bistable relay is a polarized type of relay including a permanent magnetic to maintain said relay in a position once actuated to said position.

7. A fuel burner sequencing means as described in claim 4 wherein said electromechanically operated switch means is connected to further circuit means which can be manually energized to reset said electromechanically operated switch means to recycle said fuel burner sequencing means in the event said sequencing means terminates its operation during any part of its sequence.

8. A fuel burner sequencing means as described in claim 1 wherein said alternate action safety checking means is electromechanically operated switch means including said first and said second contacts.

9. A fuel burner sequencing means as described in claim 8 wherein said electromechanically operated switch means is a bistable relay having a pair of operating coils.

10. A fuel burner sequencing means as described in claim 9 wherein said bistable relay is a polarized type of relay including a permanent magnetic to maintain said relay in a position once actuated to said position.

* * * * *